US005114266A

United States Patent [19]

Cocina, Jr.

[11] Patent Number: 5,114,266

[45] Date of Patent: May 19, 1992

[54] BARRIER APPARATUS AND METHOD OF MOUNTING SAME

[76] Inventor: Joseph Cocina, Jr., P.O. Box 65, Hamburg, N.Y. 14075

[21] Appl. No.: 652,866

[22] Filed: Feb. 8, 1991

Related U.S. Application Data

[63] Continuation-in-part of Ser. No. 571,088, Aug. 22, 1990.

[51] Int. Cl.[5] ..... E01F 13/00

[52] U.S. Cl. ..... 404/6; 256/13.1

[58] Field of Search ..... 404/6, 26; 248/205.1, 248/225.31, 200.1; 256/13.1, 68, 24

[56] References Cited

U.S. PATENT DOCUMENTS

| | | | |
|---|---|---|---|
| Re. 33,147 | 1/1990 | Reiker | 248/200.1 |
| 1,177,724 | 4/1916 | Rambo | 248/354 |
| 1,564,337 | 12/1925 | Fischbach | 256/13.1 |
| 1,658,118 | 2/1928 | Doddridge | 256/68 |
| 1,711,898 | 5/1929 | Meaker | 256/11 |
| 2,605,074 | 7/1952 | Buckso et al. | 248/225.3 |
| 3,388,892 | 6/1968 | Case | 256/24 |
| 3,806,234 | 3/1978 | Brudy | 404/6 |
| 4,348,989 | 9/1982 | Vik | 248/219.1 |

*Primary Examiner*—Ramon S. Britts
*Assistant Examiner*—Nancy P. Connolly
*Attorney, Agent, or Firm*—Hodgson, Russ, Andrews, Woods & Goodyear

[57] ABSTRACT

Apparatus for universally mounting a barrier structure. The barrier structure is sandwiched between a plurality of pairs of channel members which pairs are spaced over the length thereof. The channel members are sized so that they may be nested for receiving a flexible barrier structure or positioned back-to-back for receiving a rigid barrier structure. For use as a guardrail barrier structure, each pair of channel members is attached to a flange on a mounting bracket which is attached to the guardrail and extends laterally therefrom to the flange. The bracket may be rotated 90 degrees for mounting to a vertical as well as a horizontal guardrail. The mounting bracket is attached to a guardrail engaging strap for mouting thereof to the guardrail. The mounting bracket is provided with several spaced apertures so that it may be attached to straps of various sizes for application to various sized guardrails whereby the mounting apparatus may be simple yet effective and universally mountable. For use as a snow fence or the like, one of each pair of channel members is mounted as a post in the ground whereby the pair of channel members may be free-standing.

20 Claims, 2 Drawing Sheets

Fig. 1.
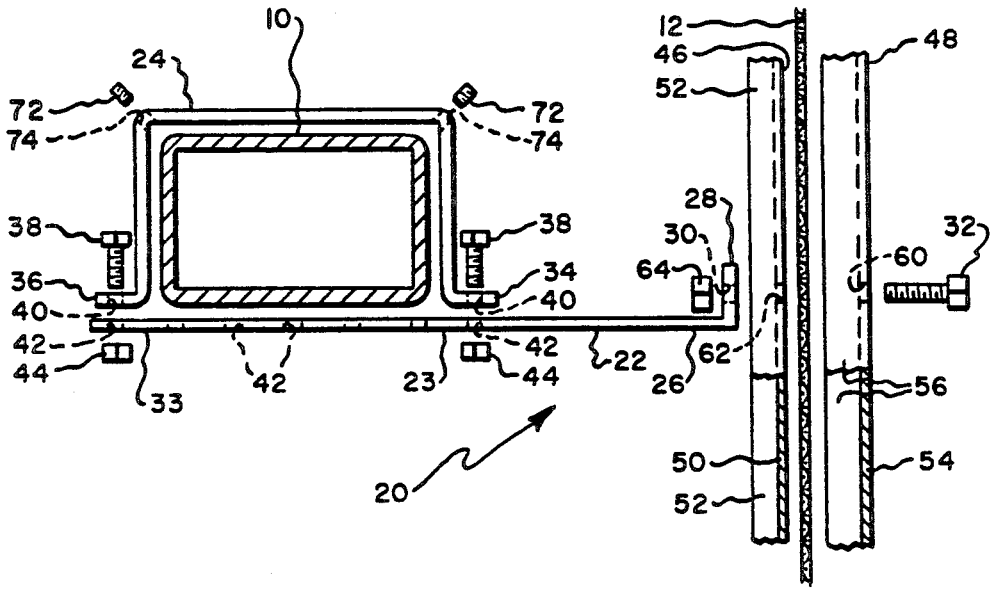
Fig. 3.
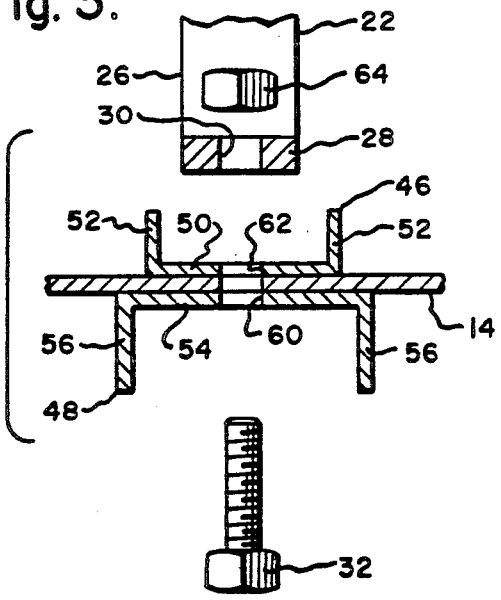
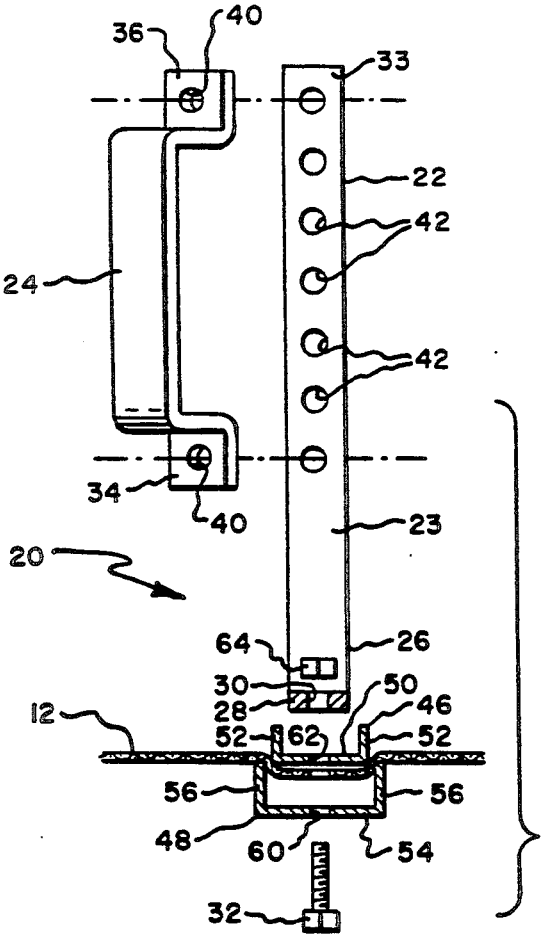
Fig. 2.

BARRIER APPARATUS AND METHOD OF MOUNTING SAME

This application is a continuation-in-part of U.S. patent application Ser. No. 571,088, filed Aug. 22, 1990 now abandoned, and the disclosure thereof is hereby incorporated by reference.

The present invention relates generally to barrier structures. More particularly, the present invention relates to apparatus and processes for mounting guardrail barrier structures, snow fences, and the like. One type of guardrail system is shown in U.S. Pat. No. 1,658,118 to Doddridge.

Art cited in the parent application discloses various mounting devices including adjustable clamping means. This art includes U.S. Pat. Nos. 1,177,724 to Rambo: 2,605,074 to Bucsko et al; 3,806,234 to Brudy; 4,348,989 to Vik; 1,564,337 to Fischbach (guard rail structure for toy railway tracks); and Re 33,147 to Reiker.

Plastic construction barrier mesh has been attached to posts to provide free-standing snow fences. It has also been used with bridge railings to prevent snow plows from dropping snow on cars below. The barrier mesh is wired to the snow fence posts or to the bridge rail, and it may be installed before the beginning of the winter season. When wire is used to attach the mesh to posts or bridge rails, the mesh is not taut enough to prevent high winds from acting in shear to loosen the structure. As a result, the mesh may fall off or otherwise require repair even before the end of the winter season. This method of snow protection thus requires a maintenance crew to repair or replace the plastic mesh at least once a year, perhaps two or three times a year, with the accompanying high maintenance cost. More permanent yet inexpensive means for providing barrier structures are desired.

A road guard fence, which need not be associated with a guardrail and which includes posts anchored in the ground so that it is free-standing, is disclosed in U.S. Pat. No. 1,711,898 to Meaker. In a complex arrangement, the fence fabric is supported parallel to the line of a plurality of posts, between cross arms of the posts, to which the upper portion of the fence fabric is attached, and springs, to which the lower portion of the fence fabric is attached, the springs being attached to members which are embedded in concrete in the ground. Such an arrangement is not suitable for mounting a barrier structure to an existing guardrail and would be very complex and expensive as a means for erecting snow fence.

U.S. Pat. No. 3,388,892 to Case discloses a complex screened highway safety rail arrangement which comprises at least two spaced horizontally disposed rails with vertically extended buffer faces, rail-standoff members integral with the rails, a plurality of vertical posts adapted to secure on the highway side thereof the integral rail-standoff members, and inter-rail screening secured between adjacent buffer face extensions of respectively adjacent rails on the off-highway side of the extensions.

While the complete screened railing assembly of the Case patent may, though perhaps expensive, provide a more permanent barrier, it requires that the railings be specifically adapted for receiving screening strips. Existing railings in the field may not be so adapted, and, if they were, it would still undesirably be required that the screening be cut to specific sizes for installation. It would therefore be desirable to provide a simple yet effective and universally adaptable means for mounting a barrier structure inexpensively and wherein the cost of maintenance is reduced.

It is accordingly an object of the present invention to provide a simple yet effective and low maintenance apparatus for mounting barrier structures to existing guardrails or as free-standing snow fences.

It is a further object of the present invention to provide such a mounting apparatus which is easily adjustable for use universally with guardrails of various sizes.

It is yet another object of the present invention to provide such a mounting apparatus which is usable with both vertical and horizontal guardrails.

It is a further object of the present invention to provide such an apparatus which allows the mounting of rigid as well as flexible barrier structures.

It is still another object of the present invention to provide such a mounting apparatus which requires no fabrication on site so that the barrier structure can be easily and quickly installed.

It is yet another object of the present invention to provide such a mounting apparatus which may be installed from the roadway side of the rail without the need for power tools for such installation.

In order to provide an effective yet simple and inexpensive barrier structure mounting apparatus, in accordance with the present invention a pair of nestable channel members are bolted together for tightly receiving a barrier structure therebetween. A plurality of such apparatus may be spaced along the length of the barrier structure to tautly position the barrier structure along the length thereof. The nestable channel members may be positioned in a back-to-back arrangement to receive a rigid barrier material therebetween whereby the user may have the option of using either flexible or rigid barrier material. The channel members may be anchored to a guardrail or may be anchored to the ground so as to provide snow fence or the like. For anchoring to a guardrail, the channel members are also bolted to a bracket which extends laterally from and is mounted to the guardrail. The bracket has several apertures spaced over a portion of its length so that it may be attached to rail straps of various sizes for attachment to various size guardrails. The bracket may be turned 90 degrees for use with vertical as well as horizontal guardrails. The references discussed above do not, whether taken together or individually, disclose or suggest such a mounting apparatus. For example, none of the references disclose or suggest the use of nestable channel members for snow fences or for tautly mounting barrier structures to existing guardrails.

Other objects, features, and advantages of the present invention will be apparent in the following detailed description of the preferred embodiments thereof when read in connection with the accompanying drawings in which like reference numerals designate the same or similar parts throughout the several views.

BRIEF DESCRIPTION OF THE DRAWINGS

FIG. 1 is a side exploded view of mounting apparatus which embodies the present invention.

FIG. 2 is a top exploded view of the mounting apparatus of FIG. 1.

FIG. 3 is a partial enlarged top exploded view similar to that of FIG. 2 illustrating the relationship of the channel members thereof for mounting a sheet barrier material.

DETAILED DESCRIPTION OF THE PREFERRED EMBODIMENTS

Figure 4:
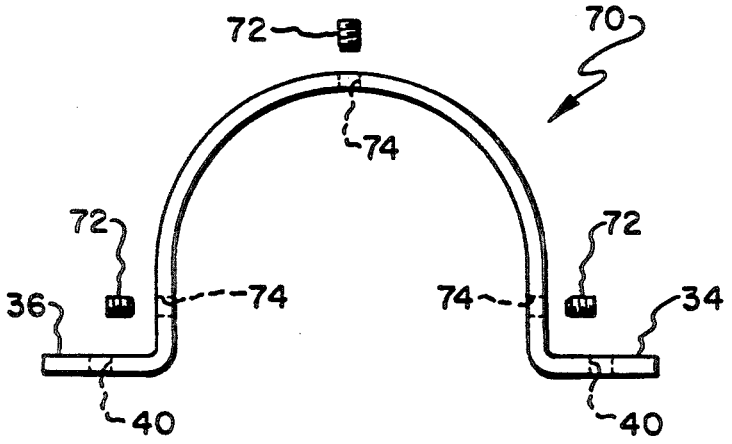
FIG. 4 is a side view of an alternative embodiment of a guardrail engaging strap for the mounting apparatus of FIG. 1.

Referring to the drawings, there is shown at 10 an existing guardrail for a bridge or other highway structure. A barrier structure is mounted to the guardrail 10 along the length thereof. The barrier structure may be a flexible material such as a plastic barrier mesh, illustrated at 12 in FIGS. 1 and 2, or it may be a rigid material such as a rigid sheet, illustrated at 14 in FIG. 3, composed of galvanized steel, plastic, aluminum, or other suitable material which may typically have a thickness of 3/8 inch and be perforated to reduce wind resistance. Other suitable barrier materials may also be used.

Illustrated generally at 20 is a mounting apparatus for mounting the barrier structure to the guardrail. A plurality of such mounting apparatus 20 may typically be spaced about 8 feet apart along the length of the guardrail 10. While the guardrail 10 is shown in the drawings to be oriented horizontally, it may be oriented otherwise such as vertically, and the same apparatus 20 is usable therewith as will be discussed hereinafter.

Mounting apparatus 20 includes an elongate generally flat mounting bracket 22 which is attached to the guardrail 10 by means of guardrail engaging strap 24 and which extends laterally from the guardrail 10 to terminate at an end portion 26. The mounting bracket 22 may be composed of aluminum or other suitable material and be suitably sized, for example, it may typically have a thickness of ½ inch, a width of 1½ inch, and a length of 12 inches. The bracket end portion 26 contains a flange 28 which extends from the end thereof at a right angle thereto and which has an aperture, illustrated at 30, for receiving bolt 32 for purposes which will be discussed hereinafter.

The mounting bracket 22 engages and extends across the width of one side of the guardrail 10 and laterally outwardly therefrom to terminate in end portion 33, which is opposite end portion 26. The rail strap 24 is an elongate member composed of aluminum or other suitable material suitably sized, for example, having typically a thickness of ½ inch and a width of 1½ inch, and suitably shaped to surroundingly engage the other three sides of the guardrail 10. Thus, as shown in FIG. 1, strap 24 has a shape to fit the cross-sectional rectangular shape of the guardrail 10. FIG. 4 illustrates at 70 an alternative strap which is arcuate in cross-section for use with pipe or round guardrail. Unless otherwise specified, references herein to strap 24 also apply to strap 70. Strap 24 terminates at its ends in flange portions 34 and 36 respectively which extend at right angles thereto for disposition parallel to bracket 22 for engaging thereof for attachment thereto. The flanges 34 and 36 are attached to the bracket 22 by means of bolts 38 which are received in apertures 40 of flanges 34 and 36 and in corresponding apertures 42 in bracket 22 and are engaged by corresponding nuts 44.

In order to adjustably and wedgingly or clampingly tighten the rail strap 24 to the guardrail 10 to insure stability under wind conditions, a plurality of perhaps two ¼ inch or other suitably sized allen screws 72 or other suitable means are preferably provided in threaded apertures 74, which extend through the thickness of the rail strap 24, whereby allen screws 72 are adjustable to extend inwardly of the rail strap 24 to wedgingly or clampingly adjustably and tightly engage the guardrail 10. The apertures 74 may be located at the strap corners as illustrated at FIG. 1 or may perhaps comprise three such apertures suitably spaced thereabout as illustrated in FIG. 4.

The rail strap 24 may be provided in several sizes having different distances between the apertures 40 to fit different size guardrails 10. In order to provide adjustability to the mounting bracket 22 so that it may be used universally with various size guardrails and with various size straps 24, in accordance with the present invention several, i.e., at least three such as perhaps seven, of the apertures 42 are spaced apart along the length of the portion of the bracket 22 which engages the guardrail 10, as shown in FIG. 2, whereby, for example, if the guardrail 10 were of a smaller size than shown in FIG. 1 and necessitated a rail strap with more closely spaced apertures 40, then the bracket 22 may still be used with the bolts 38 engaging more closely spaced ones of the several apertures 42. Thus, the mounting bracket 22 is adjustable for use with various size rail straps 24 so that the mounting apparatus may be universally used with various size guardrails 10. Other suitable means for mounting the bracket 22 to the guardrail 10 may be provided.

In accordance with the present invention the barrier structure is contained or sandwiched between two channel members 46 and 48 which are positioned to extend vertically generally over the height of the barrier structure and are composed of aluminum or other suitable material. A channel member, for the purposes of this specification and the claims, refers to a beam which has a generally U-shaped cross-section wherein a pair of flange portions extend at generally right angles from the lateral edges of an elongate central portion. Thus, channel 46 has an elongate generally flat central portion 50 flanked by flange portions 52, and channel member 48 has an elongate generally flat central portion 54 flanked by flange portions 56. The channel members 46 and 48 with the barrier structure held therebetween are attached to the bracket 22 by means of ¾ inch mounting bolt 32, or other suitably sized bolt, which is received in apertures 60 and 62 in the channel central portions 54 and 50 respectively and in bracket flange aperture 30 and threadedly engaged by nut 64 for securely fastening the channel members 46 and 48 to the barrier structure and to the bracket 22. In order to allow adjustability of the channel member heights, they may, if desired, be provided with a plurality of apertures 60 and 62 respectively spaced over their length, similarly as illustrated for the channel member 80 of FIG. 5. Other suitable means may alternatively be provided for such attachment.

If the barrier structure is not sufficiently tightly received between the channel members 46 and 48, wind forces may act in shear to tear it therefrom, thus requiring frequent maintenance. In order that the barrier structure may be tightly received between the channel members so as to reduce such wind effects and thereby reduce the amount of required maintenance, the channel members 46 and 48 are sized with one smaller than the other so that they are nestable, i.e., the smaller channel member 46 being sized such that its flange portions 52 fit between the flange portions 56 of the larger channel member 48 whereby upon tightening of the nut 64 on the bolt 32, the barrier structure 12 is caused to be tightly grasped between the nested channel members 46 and 48 as shown in FIG. 2. This allows the flexible barrier structure 12 to be tautly positioned along the length of the guardrail without the necessity of special tools and with a minimum of effort.

The channel members 46 and 48 may typically have a thickness of perhaps 3/16 inch, the distance between the flanges 52 of the smaller channel being perhaps 1½ inches, and the distance between the flanges 56 of the larger channel being perhaps 2 inches. Preferably, the flange portions 52 and 56, when the channel members are nested, face the guardrail 10, and the smaller channel member 46 is disposed inwardly (toward the guardrail) of the larger channel member 48.

The channel members 46 and 48 may be positioned so as to be spaced slightly from the sidewalk or bridge surface to prevent corrosion thereto and may be extended upwardly perhaps 25 percent higher than the bridge rail height. The edges of the channel members 46 and 48 which come in contact with the barrier structure are preferably ground to a smooth rounded finish to prevent tearing of the barrier material.

Referring to FIG. 1, the mounting bracket 22, having a flat elongate portion 23 with a flange at its end, is thus shaped so that it can be oriented, merely by rotating it 90 degrees from its position as shown in FIG. 1, for application to a vertical as well as a horizontal guardrail for the attachment of its flange 28 to the channel members 46 and 48. Thus, no different hardware is required for its use with vertical guardrails.

If it is desired that the channel members 46 and 48 be closely adjacent the guardrail, the mounting bracket 22 may be accordingly shortened and turned 180 degrees from its position as shown in FIG. 1 so that flange 28 extends downwardly therefrom so that flange 34 does not interfere with the installation of bolt and nut 32 and 64 respectively.

The meshed material for barrier structure 12 is generally considered to be a disposable item, although the mounting apparatus 20 of the present invention allows it to be tautly secured so that it may be retained in good condition over a longer period of time with less maintenance required. Barriers composed of sheet material, illustrated at 14 in FIG. 3 and previously discussed, may be used for a more permanent and maintenance free installation. In order to position the rigid sheet barrier structure 14 between the channel members 46 and 48, a feature of channel members 46 and 48 is that they are reversible, as illustrated in FIG. 3, i.e., they are disposable back-to-back so that their flange portions 52 and 56 extend away from the barrier structure 14, and both channel member central portions 50 and 54 engage respectively opposite sides of the barrier sheet 14 and are attached to the barrier sheet 14 and each other and to the bracket flange 28 with the bolts 32 received in apertures 30, 60, and 62 and an aperture in the barrier structure 14 similarly as described with reference to FIG. 2. This allows the same hardware to be used for mounting either a flexible or rigid barrier structure so that the customer may, if desired, begin with a lower cost meshed barrier structure and easily and inexpensively upgrade to a more permanent and maintenance free sheet barrier structure at a later date without the necessity of replacing any hardware.

Figure 5:
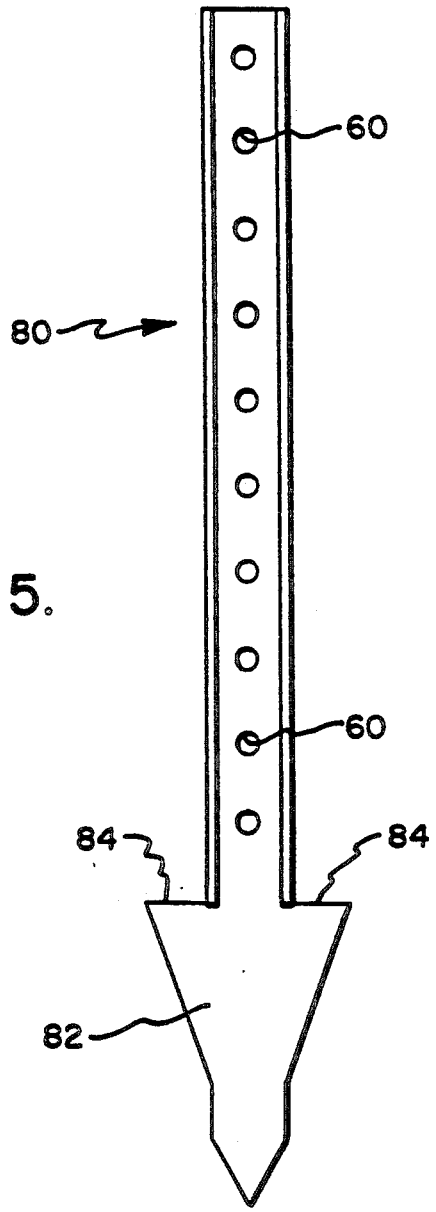
FIG. 5 is a front elevation view of a post which may be used for a channel member of the pair of channel members of FIG. 1 so that they may be free-standing for use as snow fence.

Referring to FIG. 5, there is illustrated at 80 a channel member which may constitute one of a pair of nestable channel members similar to nestable channel members 46 and 48. However, instead of being attached to a guardrail by means of a mounting bracket, the nestable pair of channel members includes a channel member 80 which is anchored in the ground and nestable with, for example, channel member 46 so that a plurality of such nestable pairs with barrier structure 12 or 14 therebetween, similarly as shown and described for FIGS. 1 to 3 but without attachment to the bracket 22, may provide a snow fence or the like which is free-standing. Thus, channel member 80 includes on its lower end portion or base a pointed ground-piercing member 82 with a pair of flanges 84 for driving it into the ground so that channel member 80 becomes a fence post. Other suitable ground-engaging means may alternatively be provided. A plurality of apertures 60 in post 80 and spaced over its length and corresponding apertures 62 in channel member 46 nestable therewith are engaged by bolts 32 and nuts 64 or other suitable attachment means with the barrier structure 12 or 14 therebetween, similarly as shown for the channel members 46 and 48 of FIGS. 1 to 3 but without the bracket 22 attached thereto The reversible nested channel members 46 and 48 are thus provided to allow easy but effective and more permanent and interchangeable installation of both meshed and sheet barrier structures. The mounting bracket is provided with several spaced apertures 42 to allow mounting to guardrails of various sizes and is constructed so that it may be turned 90 degrees, from its position as shown in FIG. 1, for application to vertical as well as horizontal guardrails to thereby provide further versatility and universality of the mounting apparatus 20. One of the channel members may be provided with ground-piercing means, as illustrated in FIG. 5, so that the nestable channel members may be free-standing, instead of mounted to a guardrail, as illustrated in FIGS. 1 to 4, for use for a snow fence or the like. Thus, there is provided, in accordance with the present invention, a barrier mounting apparatus which may be simple but effective and inexpensive and which may require no fabrication on site, which may be easy to install and maintain, which may be installed from the roadway side of the rail without the need for power tools for such installation, which may reduce the inconvenience of having to carry around various sizes of hardware to fit various size guardrails on different projects, which may reduce the frequency of required maintenance for additional cost savings, which may allow easy access for replacing the barrier structure, and which may allow the customer to begin with a lower cost option and inexpensively upgrade to a more permanent and maintenance free option at a later date.

It is to be understood that the invention is by no means limited to the specific embodiments which have been illustrated and described herein and that modifications may indeed be made which come within the scope of the present invention as defined by the appended claims.

What is claimed is:

1. Barrier apparatus comprising a barrier structure extending over a predetermined length and a plurality of means spaced apart generally over at least a portion of said predetermined length for mounting said barrier structure, said mounting means comprising a pair of channel members which are reversible between a nested and back-to-back position with said barrier structure received therebetween, said channel members being attached to each other with said barrier structure received therebetween so that said barrier structure may be tautly attached to said mounting means over at least a portion of said predetermined length, and means for anchoring said channel members with said barrier structure received therebetween.

2. Barrier apparatus according to claim 1 wherein said barrier structure is a flexible structure and said channel members are disposed in a nested relationship.

3. Barrier apparatus according to claim 1 wherein said barrier structure is composed of a rigid material and said channel members are disposed in a back-to-back relationship.

4. Barrier apparatus according to claim 1 wherein said anchoring means comprises ground-piercing means on an end portion of one of said channel members whereby said one channel member may be driven into the ground so that the barrier apparatus is free-standing.

5. Barrier apparatus according to claim 1 wherein said anchoring means comprises bracket, means for attaching said bracket to a guardrail with said bracket extending laterally from the guardrail to terminate at an end portion, and means for attaching said channel members with said barrier structure received therebetween to said bracket end portion.

6. Barrier apparatus according to claim 5 wherein said means for attaching said bracket to a guardrail comprises a guardrail engaging strap and several aperture means spaced apart over a portion of the length of said bracket providing adjustable orientation with aperture means in said strap such that said bracket can be attached to straps of various sizes for application of the mounting means to guardrails of various sizes.

7. An apparatus for mounting a barrier structure to a guardrail comprising a bracket, means for attaching said bracket to a guardrail with said bracket extending laterally from the guardrail to terminate at an end portion, a pair of channel members which are nestable for tightly receiving a barrier structure therebetween, and means for attaching said channel members to said bracket end portion whereby a plurality of the apparatus may be spaced along the length of a guardrail to tautly position a barrier structure along the length thereof

8. Apparatus according to claim 7 wherein said channel members are reversible from their nested position so that they may be positioned back-to-back for mounting therebetween of a barrier structure composed of a rigid material.

9. Apparatus according to claim 7 wherein said means for attaching said bracket to a guardrail comprises a guardrail engaging strap and several aperture means spaced apart over a portion of the length of said bracket providing adjustable orientation with aperture means in said strap such that said bracket can be attached to straps of various sizes for application of the mounting apparatus to guardrails of various sizes.

10. Apparatus according to claim 7 wherein said bracket comprises an elongate portion and said bracket end portion comprises a flange portion extending perpendicularly to said elongate portion and having an aperture therein for receiving bolt means for attaching said channel members to said flange portion whereby said bracket may be used with guardrails which are oriented in both vertical and horizontal directions.

11. Apparatus according to claim 10 wherein said means for attaching said bracket to a guardrail comprises a guardrail engaging strap and several aperture means spaced apart over a portion of the length of said bracket providing adjustable orientation with aperture means in said strap such that said bracket can be attached to straps of various sizes for application of the mounting apparatus to guardrails of various sizes.

12. Apparatus according to claim 11 wherein said channel members are reversible from their nested position so that they may be positioned back-to-back for mounting therebetween of a barrier structure composed of a rigid material.

13. Barrier apparatus comprising a barrier structure disposed generally parallel to a guardrail and a plurality of means spaced apart over at least a portion of the length of the guardrail for mounting said barrier structure to the guardrail, at least one of said mounting means comprising a bracket, means for attaching said bracket to the guardrail with said bracket extending laterally from the guardrail to terminate at an end portion, said bracket attaching means comprising a guardrail engaging strap and several aperture means spaced apart over a portion of the length of said bracket providing adjustable orientation with aperture means in said strap such that said bracket can be attached to straps of various sizes for application of the mounting means to guardrails of various sizes, said bracket comprises an elongate portion, said bracket end portion comprises a flange portion extending perpendicular to said elongate portion, a pair of elongate members with said barrier structure received therebetween, and means for attaching said elongate members with said barrier structure therebetween to said bracket flange portion whereby said bracket may be used with guardrails of various sizes which are oriented in both vertical and horizontal directions.

14. Barrier apparatus according to claim 13 wherein said elongate members are channel members which are nestable for receiving a flexible barrier structure therebetween and which are positionable in a back-to-back relation for receiving a barrier structure composed of a rigid material therebetween.

15. A method for mounting a barrier structure comprising the steps of:

a. positioning the barrier structure between a pair of channel members at each of a plurality of locations along the barrier structure length which channel members are reversible between a nested and a back-to-back position;

b. attaching the pair of channel members with the barrier structure positioned therebetween to each other and to the barrier structure whereby the barrier structure may be tautly positioned along its length; and c. anchoring the pair of channel members.

16. A method according to claim 15 further comprising selecting the barrier structure to be composed of a flexible material, and nesting the flexible material between the pair of channel members.

17. A method according to claim 15 further comprising selecting the barrier structure to be composed of a rigid material, and positioning the pair of channel members in a back-to-back position.

18. A method according to claim 15 wherein the step of anchoring the pair of channel members comprises driving an end portion of one of the pair of channel members into the ground so that it acts as a post for supporting the barrier structure.

19. A method according to claim 15 wherein the step of anchoring the pair of channel members comprises attaching a bracket to a guardrail and orienting the bracket to extend laterally from the guardrail to terminate at an end portion, and attaching the pair of channel members with the barrier structure positioned therebetween to the bracket end portion.

20. A method according to claim 19 further comprising selecting the bracket to have several apertures spaced apart over a length of the bracket providing adjustable orientation with apertures in a guardrail engaging strap such that the bracket can be attached to straps of various sizes for application of the bracket to guardrails of various sizes, and attaching the bracket to the strap to mount the bracket to the guardrail.

* * * * *